US011118599B2

(12) United States Patent
Sakoda et al.

(10) Patent No.: US 11,118,599 B2
(45) Date of Patent: Sep. 14, 2021

(54) FAN AND AIR-CONDITIONING APPARATUS EQUIPPED WITH FAN

(71) Applicant: Mitsubishi Electric Corporation, Chiyoda-ku (JP)

(72) Inventors: Kenichi Sakoda, Chiyoda-ku (JP); Tomoya Fukui, Chiyoda-ku (JP); Masayuki Oishi, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 613 days.

(21) Appl. No.: 15/579,803

(22) PCT Filed: May 10, 2016

(86) PCT No.: PCT/JP2016/063878
§ 371 (c)(1),
(2) Date: Dec. 5, 2017

(87) PCT Pub. No.: WO2017/026150
PCT Pub. Date: Feb. 16, 2017

(65) Prior Publication Data

US 2018/0355884 A1 Dec. 13, 2018

(30) Foreign Application Priority Data

Aug. 10, 2015 (JP) ..... JP2015-158258

(51) Int. Cl.
*F04D 29/38* (2006.01)
*F04D 29/32* (2006.01)
(Continued)

(52) U.S. Cl.
CPC ..... *F04D 29/384* (2013.01); *F04D 29/325* (2013.01); *F04D 29/663* (2013.01);
(Continued)

(58) Field of Classification Search
CPC .... F04D 29/325; F04D 29/384; F04D 29/663; F04D 29/666; F04D 29/681;
(Continued)

(56) References Cited

U.S. PATENT DOCUMENTS 5,540,406 A 7/1996 Occhipinti
6,296,446 B1 10/2001 Ishijima et al.
(Continued)

FOREIGN PATENT DOCUMENTS

JP 2001-153400 A 6/2001
JP 2002-054596 A 2/2002
(Continued)

OTHER PUBLICATIONS

English translation of JP 2000110790 A, (Year: 2000).*
(Continued)

*Primary Examiner* — Kenneth Bomberg
*Assistant Examiner* — Julian B Getachew
(74) *Attorney, Agent, or Firm* — Xsensus LLP

(57) ABSTRACT

A fan includes an impeller including a boss serving as a center of rotation and a plurality of blades provided on an outer circumferential surface of the boss, and a structure member installed on an upstream side of the impeller in an airflow direction. The plurality of blades each have a plurality of recesses disposed only on a side of a suction surface of a leading edge. The plurality of recesses each have a rectangular shape having two longitudinal sides. Consequently, it is possible to reduce fluctuations of lift on the plurality of blades and thereby reduce discrete frequency noise.

16 Claims, 6 Drawing Sheets

(51) Int. Cl.
*F04D 29/66* (2006.01)
*F04D 29/68* (2006.01)

(52) U.S. Cl.
CPC ..... *F04D 29/681* (2013.01); *F05D 2240/303* (2013.01); *F05D 2250/12* (2013.01)

(58) Field of Classification Search
CPC ..... F04D 29/326; F04D 29/38; F04D 29/66; F04D 29/661; F04D 29/667; F04D 29/68; F05D 2240/303; F05D 2250/12; F05D 2260/96
See application file for complete search history.

(56) References Cited

U.S. PATENT DOCUMENTS

| | | | |
|---|---|---|---|
| 2010/0183445 | A1 | 7/2010 | Jia |
| 2013/0323098 | A1 | 12/2013 | Ooya et al. |

FOREIGN PATENT DOCUMENTS

| | | | |
|---|---|---|---|
| JP | 4035237 | B2 | 1/2008 |
| JP | 4153601 | B2 | 9/2008 |
| JP | 4321689 | 82 | 8/2009 |
| JP | 2010-203409 | A | 9/2010 |
| JP | 2014-025426 | A | 2/2014 |

OTHER PUBLICATIONS

Chinese Office Action dated Sep. 27, 2019 in Patent Application No. 201680045461.8 (with unedited computer generated English translation), 8 pages.
Indian Office Action dated Jan. 22, 2020 in Indian Patent Application No. 201847003363, 6 pages.
Combined Chinese Office Action and Search Report dated Jul. 8, 2019 in Patent Application No. 201680045461.8 (with unedited computer generated English translation of the Office Action and English translation of Categories of Cited Documents), 10 pages.
Office Action dated Sep. 28, 2018 in Australia Patent Application No. 2016305781. 3 pages.
Combined Office Action and Search Report dated Dec. 25, 2018 in Chinese Patent Application No. 201680045461.8, citing document AA therein, 10 pages (with English translation and English translation of categories of cited documents).
Office Action dated Feb. 22, 2019 in European Patent Application No. 16834847.2 citing document AO therein, 6 pages.
Extended European Search Report dated Jun. 18, 2018 in Patent Application No. 16834847.2 citing references AA—AB and AO therein, 8 pages.
Office Action dated Dec. 15, 2016 in Japanese application No. 2016-561408 (with partial English translation).
International Search Report dated Jul. 19, 2016 in PCT/JP2016/063878, filed on May 10, 2016 (English translation thereof).

* cited by examiner (a)

(b)

FAN AND AIR-CONDITIONING APPARATUS EQUIPPED WITH FAN

TECHNICAL FIELD

The present invention relates to a fan and an air-conditioning apparatus equipped with the fan, and more particularly, to stable driving of an impeller.

BACKGROUND ART

A fan such as an axial fan and a mixed flow fan is equipped with an impeller that includes a boss serving as a center of rotation and plural blades provided on an outer circumference of the boss. Fans of various configurations have been proposed conventionally.

For example, as such a type of fan, a fan is proposed in which plural ribs are provided on a leading edge portion of each blade on a suction surface side, extending from an outside leading edge to a rear end of the blade (see, for example, Patent Literature 1). The ribs are disposed in parallel to a tangent to a circular arc centered on a center of an arc portion on the side of circumferential leading edges of the blades by passing through an intersection between the circular arc and a leading edge of the blade to prevent flow separation on a suction surface of the blade and reduce noise.

CITATION LIST

Patent Literature

Patent Literature 1: Japanese Patent No. 4035237 (FIG. 1)

SUMMARY OF INVENTION

Technical Problem

For example, in installing a fan on an air-conditioning apparatus or other apparatus, generally a structure member such as a filter and a finger guard adapted to prevent admixture of foreign matter and other matter is placed upstream of an impeller in an airflow direction. For example, when such a structure member is placed in the vicinity of the impeller on an upstream side of the impeller, an air current on a downstream side of the structure member becomes unstable, causing lift on impeller blades to fluctuate. The fluctuation of lift poses a problem in that harsh discrete frequency noise is generated.

The present invention has been made to solve the above problem and has an object to provide a fan and other devices capable of reducing fluctuations of lift on blades.

Solution to Problem

An embodiment of the present invention provides a fan including an impeller including a boss serving as a center of rotation and a plurality of blades provided on an outer circumferential surface of the boss, and a structure member installed on an upstream side of the impeller in an airflow direction. The plurality of blades each have a plurality of recesses disposed only on a side of a suction surface of a leading edge. The plurality of recesses each have a rectangular shape having two longitudinal sides.

Advantageous Effects of Invention

According to an embodiment of the present invention, the recesses disposed in a leading edge portion of each blade can slow down velocity of air that has passed through the structure member, the velocity of air varying with the position in the leading edge portion, and thereby reduce fluctuations of lift on the blade. The reduction in the fluctuations of lift can inhibit generation of discrete frequency noise.

DESCRIPTION OF EMBODIMENTS

Figure 1:
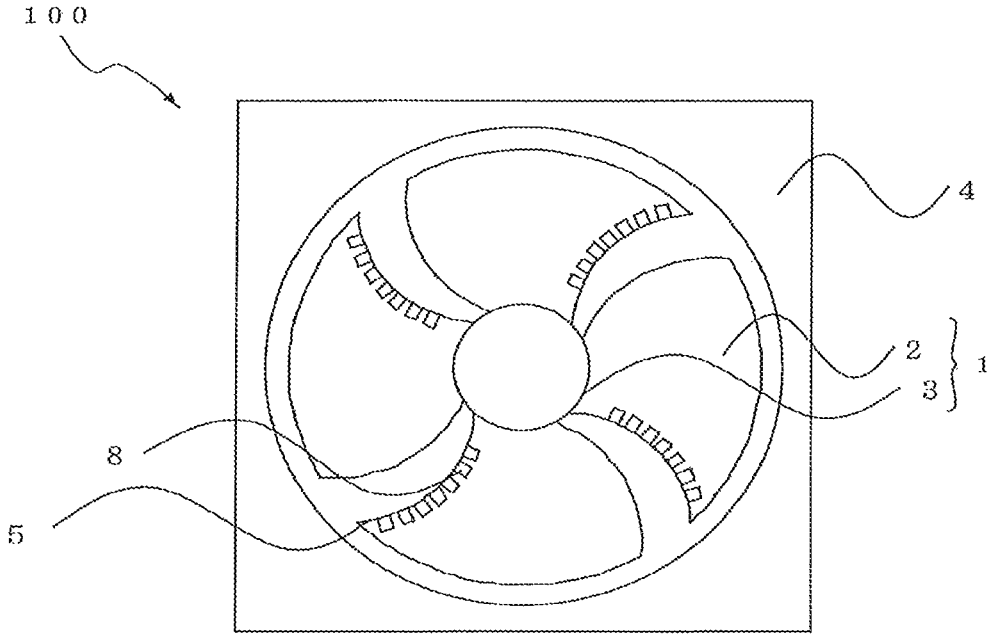
FIG. 1 is a diagram showing an example of a fan 100 according to Embodiment 1 of the present invention.

A fan and other devices according to embodiments of the present invention will be described below with reference to the drawings and other figures. In the following drawings, the same components or equivalent components are denoted by the same reference signs and are common throughout the entire text of the embodiments described below. The forms of the components described throughout the entire text of the specification are strictly exemplary, and the components are not limited to the forms described herein. In particular, combinations of components are not limited to those described in any of the embodiments, and components described in one embodiment may be applied to another embodiment. Also, the upper side and lower side of the drawings correspond to the "upper side" and "lower side" in the following description. Also, in the following description, the terms "upstream" and "downstream" are used with reference to a flow of a fluid such as air. Furthermore, components of the same kinds distinguished by subscripts may be described without the subscripts when the components do not have to be distinguished or identified from one another. Besides, in the drawings, components may not be shown in their true size relations.

Embodiment 1

FIG. 1 is a diagram showing an example of a fan 100 according to Embodiment 1 of the present invention. FIG. 1 shows the fan 100 as viewed from a suction-surface side that is an air inflow side. The fan 100 according to Embodiment 1 is, for example, an axial fan, mixed flow fan, or other devices. The fan 100 includes an impeller 1 and a casing 4.

The impeller 1 includes a boss 3 serving as a center of rotation (rotating axis) of the impeller 1 and plural blades 2 provided on an outer circumferential surface of the boss 3. The boss 3 of the impeller 1 is connected to a motor (not shown) adapted to rotationally drive the impeller 1. The impeller 1 is configured to move air in a direction away from the viewer in FIG. 1 by being rotated by a driving force of the motor. Also, a casing 4 serving as a housing houses the impeller 1 by being installed on an outer circumferential side of the impeller 1 with a gap provided between the casing 4 and an outer circumferential portion of the impeller 1. For example, a bell-mouth or a similar component is attached to the casing 4 to rectify a flow of air flowing into the impeller 1.

Figure 2:
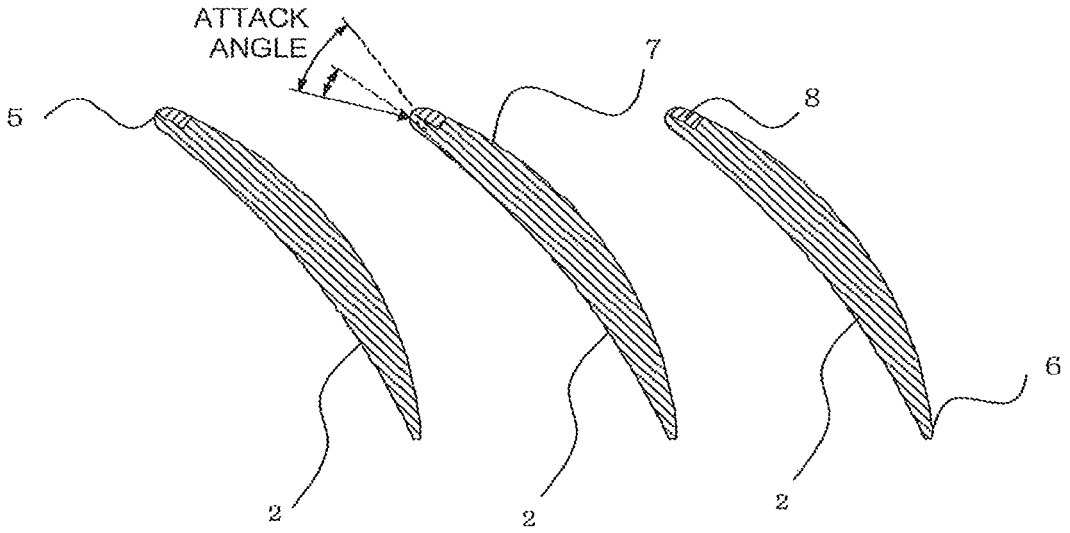
FIG. 2 is a diagram showing a blade cascade obtained from blades 2 of the fan 100 according to Embodiment 1 of the present invention by developing a cylindrical section at a certain radius into a plane.

FIG. 2 is a diagram showing a blade cascade obtained from blades 2 of the fan 100 according to Embodiment 1 of the present invention by developing a cylindrical section at a certain radius into a plane. In the fan 100 according to the present embodiment, each of the blades 2 of the impeller 1 has plural recesses 8 in a leading edge portion 5 of the blade 2. Each of the recesses 8 is a rectangular groove formed extending from the leading edge portion 5 to a trailing edge portion 6 when each of the recesses 8 is viewed in an axial direction. The rectangular shape here includes a square shape. One side of the rectangular shape is located on the leading edge portion 5 and provides an inlet for airflow into the groove from a leading edge. One side of the rectangular shape on the side of the trailing edge portion 6 differs in height from a suction surface in which no groove is formed and the air flowing inside the groove is released to the suction surface in the stepped portion.

The recesses 8 are aligned on the side of the suction surface 7 of the blade 2 along the leading edge portion 5. The blade 2 is made of a material having a thickness between the suction surface and a pressure surface and the recesses 8 are formed only on the suction surface. A depth of the recesses 8 is, for example, 20 to 70% the thickness of the blade 2. On the other hand, the trailing edge portion 6 of the blade 2 decreases in thickness toward the trailing edge and no recess 8 is formed in the trailing edge portion 6. In the present embodiment, the plural recesses 8 are aligned at equal intervals along the leading edge portion 5. Also, spacing between adjacent recesses 8 along the leading edge portion 5 is about equal to a width of the recess 8 (spacing between two longitudinal sides of the rectangular shape) and can be, for example, about 0.5 to 3.0 times the width of the recess 8. It is advisable that the spacing is about 0.8 to 2.0 times the width of the recess 8. Furthermore, each recess 8 is disposed such that the two longitudinal sides of the rectangular shape will extend in parallel to each other along a normal to a line connecting the center of rotation of the impeller 1 to the leading edge in the leading edge portion 5. A length of the recess 8 in a longitudinal direction is, for example, about equal to the thickness of the blade 2 (70 to 150% the thickness). Also, the recesses 8 may be provided in portions of the leading edge portion 5 that are close to an outer circumference, but not in portions that are close to the boss 3.

Figure 4:
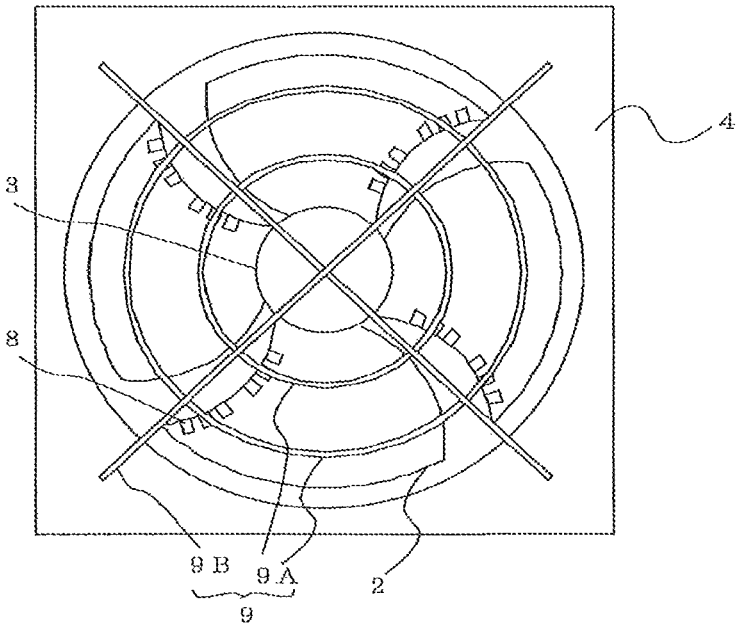
FIG. 4 is a diagram illustrating an example of a fan 100 according to Embodiment 2 of the present invention with a structure member 9 attached.

Next, description will be given of the effect of disposing the recesses 8 in the leading edge portions 5 of the blades 2 in a configuration of the fan 100 shown in the present embodiment. Generally, when a fan 100 is used by being installed in an air-conditioning apparatus, from the viewpoint of preventing admixture of foreign matter, from the viewpoint of safety, and other considerations, for example, as shown in FIG. 4 and other drawings described later, a structure member 9 such as a filter an a finger guard is placed on an upstream side of the impeller 1 in the airflow direction. Here, because of installation space limitations, the structure member 9 is often installed in the vicinity of the impeller 1. Also, to facilitate flow of air and improve fan efficiency of the fan 100, the structure member 9 is often formed by combining thin members in a grid pattern or a circular pattern.

Figure 3:
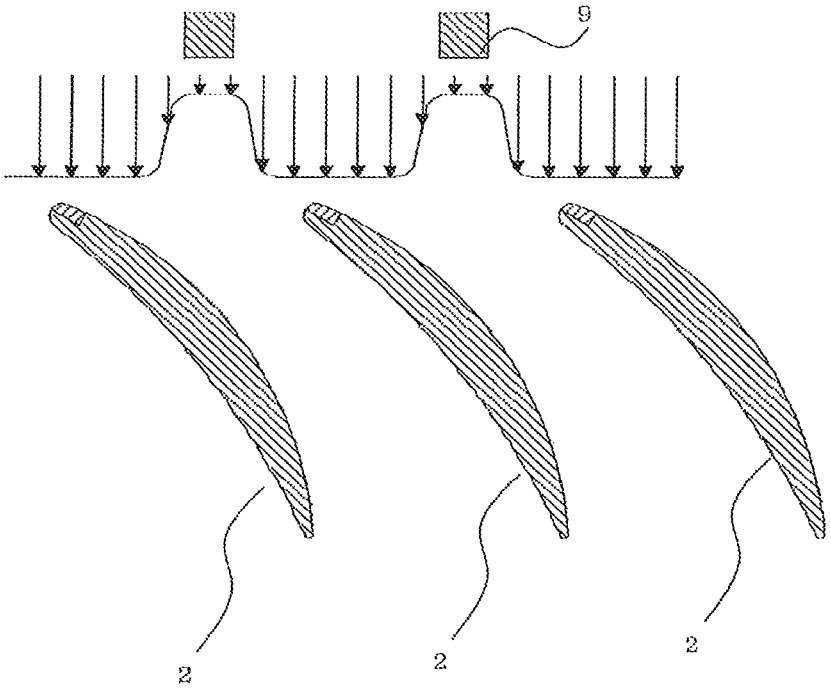
FIG. 3 is a diagram showing a blade cascade obtained from the blades 2 of the fan 100 according to Embodiment 1 of the present invention by developing a cylindrical section at a certain radius into a plane and an outline of an air velocity distribution when a structure member 9 is placed on an upstream side of an impeller 1.

FIG. 3 is a diagram showing a relationship between a blade cascade obtained from the blades 2 of the fan 100 according to Embodiment 1 of the present invention by developing a cylindrical section at a certain radius into a plane and an outline of an air velocity distribution when a structure member 9 is placed on an upstream side of the impeller 1. For example, because the structure member 9 blocks the flow of air, a wake in which velocity of air is low is formed on a downstream side of the structure member 9 in an airflow direction. Here, when the structure member 9 is installed close to the impeller 1 on an upstream side of the impeller 1, in particular, the wake reaches locations of the blades 2. Consequently, air reaches the blades 2 without being slowed down. For example, when a distance between the blades 2 and structure member 9 differs greatly from diameter of the blades 2, the velocity of air varies with the locations of the blades 2. Consequently, an influence on the flow of air produced by rotation of the impeller 1 is significant.

For example, with a fan 100 of a conventional configuration, when the impeller 1 is rotating, an inflow angle of an air current toward each blade 2 changes in the process in which the blade 2 passes through the wake. Because the blade 2 passes through the wake periodically, periodic fluctuations of lift occur on the blade 2, generating harsh discrete frequency noise.

On the other hand, when plural recesses 8 are disposed in the leading edge portion 5 of the blade 2 as with the fan 100 shown in Embodiment 1, a substantial attack angle of the air current in the leading edge portion 5 varies between a portion in which the recesses 8 are disposed and a portion in which no recess 8 is disposed. FIG. 2 shows that in a portion in which the recesses 8 about half as thick as the blade 2 are formed, the attack angle is reduced to about one half due to the reduced thickness of the leading edge portion 5.

More specifically, a velocity component in a direction of the rotating axis of the fan 100 decreases in the wake. Consequently, the attack angle is small in the portion in which the recesses 8 are disposed and large in the portion in which no recess 8 is disposed. Consequently, the fluctuations of lift occurring on the blade 2 when the rotating blade 2 passes through the wake of the structure member 9 differ between the portion in which the recesses 8 are provided and the portion in which no recess 8 is provided. According to Embodiment 1, a portion in which the recess 8 is formed and a portion in which no recess 8 is formed are arranged alternately along the leading edge. A position where lift is large due to wake flow behind the structure member 9 shifts due to differences in fluctuations of the lift. As a result, the fluctuations of lift occurring on the blade 2 are small as a whole. Also, because the width of the recesses 8 is roughly equal to a distance between the recesses 8, the fluctuations of lift can be reduced properly.

Also, the recess 8 is formed into a rectangular shape to have the longitudinal direction perpendicular to the leading edge portion 5. Consequently, in the leading edge portion 5, the air current flowing along the suction surface 7 of the blade 2 is disturbed. Consequently, when the blade 2 passes through the wake, an amount of change in velocity relative to the blade 2 is reduced, further reducing the fluctuations of lift occurring on the blade 2.

Thus, with the fan 100 of the configuration according to Embodiment 1, even when a structure member 9 is installed on the upstream side of the fan 100, it is possible to reduce discrete frequency noise caused by interference between the wake of the structure member 9 and the blade 2.

Embodiment 2

The fan 100 according to Embodiment 1 reduces fluctuations of lift on the blade 2 and inhibits generation of discrete frequency noise by disposing plural recesses 8 in the leading edge portion 5 of the blade 2. By adjusting the positions where the recesses 8 are disposed, the fan 100 according to the present embodiment achieves the effect of reducing discrete frequency noise more efficiently. In Embodiment 2, items and other features not described specifically are similar to corresponding items according to Embodiment 1. Also, components and other parts having the same functions, configurations, and other features as those of Embodiment 1 are denoted by the same reference signs as the corresponding components of Embodiment 1.

FIG. 4 is a diagram illustrating an example of a fan 100 according to Embodiment 2 of the present invention with a structure member 9 attached. FIG. 4 shows the fan 100 as viewed in the direction of the rotating axis, with the structure member 9 mounted on the upstream side in the airflow direction. In the fan 100 according to Embodiment 2, plural recesses 8 are disposed in the suction surface 7 on the leading edge portion 5 of each blade 2 to deal with an area in which a strong wake is created by the structure member 9 installed on the upstream side of fan 100. Plural recesses 8 are arranged at intervals in each area. For example, the structure member 9 in FIG. 4 is a protective device made up of plural ring-shaped members 9A differing in diameter and bar-shaped members 9B supporting the ring-shaped members 9A. The ring-shaped members 9A are circular or partially circular portions centered on the rotating axis. The bar-shaped members 9B extend radially from a center of the rotating axis. The ring-shaped members 9A and bar-shaped members 9B may be made of one continuous material.

With such structure member 9, velocity changes greatly in the wakes, especially in areas where ring-shaped members 9A and bar-shaped members 9B intersect each other, generating significant discrete frequency noise. Also, when the blades 2 are viewed in the direction of the rotating axis, wake flow is generated toward the blades 2 along entire circumferences of the ring-shaped members 9A. When the blades 2 are viewed radially outward from the center of the rotating axis, parts of the blades 2 that extend from the center of the rotating axis to the radii of the ring-shaped members 9A are affected greatly by the wake flow. The recesses 8 correspond to the parts of the blades 2 affected greatly by the wake flow as described above. For example, when a given blade 2 is viewed in the direction of the rotating axis, the recesses 8 can be disposed, covering portions affected by the wake flow by being overlapped by the ring-shaped members 9A over at least ¼ of the entire circumference during one rotation of the blade 2.

On the other hand, the bar-shaped members 9B extend radially in a radial direction. Consequently, influence of wake flow occurs only in a very small portion of the entire circumference, and portions in the vicinity of the bar-shaped members 9B are not affected significantly. Consequently, as shown in FIG. 4, the portion between the two ring-shaped members 9A differing in diameter is not affected significantly by wake flow. Thus, it is not always necessary to dispose the recesses 8.

However, even behind objects extending radially in the radial direction, portions of the blades 2 that are very close to the objects are greatly affected by the wake flow. Consequently, it is advisable to dispose recesses 8 not only behind the ring-shaped members 9A, but also, for example, at positions of the blades 2 that approach the structure member 9 to a distance of 1/20 or less of a diameter of the blades 2. In particular, the blades 2 are affected greatly by wake flow in an outer circumferential portion where velocity becomes high. Thus, for example, recesses 8 may be provided in a range of 60 to 100% from a center side in the radial direction of each blade 2.

As described above, when the blades 2 are viewed in the direction of the rotating axis, on the structure member 9, a position at which a large part of the structure member 9 overlaps the blades 2, a position at which plural members intersect or branch off, and a position at which the structure member 9 comes very close to the blades 2 are positions at which the structure member 9 interferes with the leading edge portions 5 of the blades 2. Thus, in the fan 100 according to Embodiment 2, the recesses 8 are disposed in positions on the leading edge portions 5 of the blades 2 that interfere with the structure member 9.

This configuration inhibits generation of discrete frequency noise caused by interference of the wake created by the structure member 9 installed on the upstream side of the fan 100 with the blades 2. Also, the fan 100 according to the present embodiment can prevent deterioration in fan performance, including reduction in a flow rate and reduction in pressure increase, caused by installation of plural recesses 8 in the leading edge portion 5 of each blade 2.

For example, when the recesses 8 are disposed in the leading edge portion 5 of each blade 2, the air current flowing along the suction surface 7 of the blade 2 is disturbed in the leading edge portion 5. Consequently, the fluctuations of lift occurring on the blade 2 can be mitigated, and drag occurring on the blade 2 increases. Consequently, the fan performance of the fan 100 is deteriorated as well. However, in the fan 100 according to Embodiment 2, as the recesses 8 are disposed in areas affected greatly by the wake flow created by the structure member 9 installed on the upstream side of the fan 100, the deterioration in fan performance can be reduced.

Embodiment 3

Figure 5:
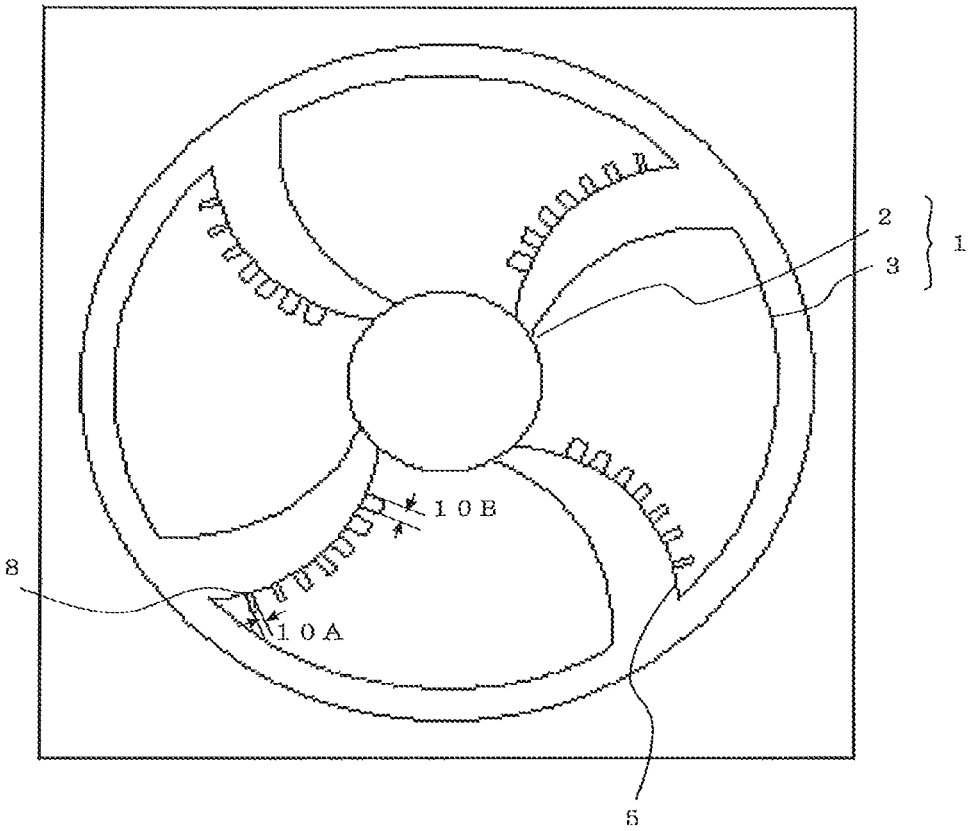
FIG. 5 is a diagram showing an example of a fan 100 according to Embodiment 3 of the present invention.

FIG. 5 is a diagram showing an example of a fan 100 according to Embodiment 3 of the present invention. FIG. 5 shows the fan 100 as viewed from the side of the suction surface 7. In Embodiment 3, items and other features not described specifically are similar to corresponding items according to Embodiment 1 or 2. Also, components and other parts having the same functions, configurations, and other features as in Embodiment 1 or 2 are denoted by the same reference signs as the corresponding components of Embodiment 1 or 2.

The fan 100 shown in FIG. 5 is configured such that, of rectangular recesses 8 disposed in the leading edge portions 5 of the blades 2, a width dimension 10A of the recesses 8 disposed on an outer circumferential side of the blades 2 is smaller than a width dimension 10B of the recesses 8 disposed on an inner circumferential side. This configuration effectively reduces discrete frequency noise when the wake created by the structure member 9 installed on the upstream side of the fan 100 is located on the outer circumferential side of the blades 2 in the fan 100.

For example, the impeller 1 includes a boss 3 serving as a center of rotation and plural blades 2 provided on the outer circumferential surface of the boss 3. The blades 2 extend in the radial direction of the boss 3 to be attached. Circumferential velocity of the blades 2 when the impeller 1 is rotated increases on the outer circumferential side of the blades 2. Consequently, velocity of incoming airflow relative to the blades 2 increases on the outer circumferential side of the blades 2. Consequently, a thickness of a velocity boundary layer formed on a blade surface of each blade 2 is thinner on the outer circumferential side of the blade 2 than on the inner circumferential side.

The recesses 8 provided in the leading edge portions 5 of the blades 2 disturb flow in the leading edge portions 5, reducing fluctuations of lift caused when the blades 2 pass through the wake created by the structure member 9 installed on the upstream side of the fan 100. This effect can be obtained by breaking the velocity boundary layer formed on the blade surface of each blade 2. Consequently, the width dimension 10 of the recesses 8 formed in the leading edge portion 5 may be about equal to the thickness of the velocity boundary layer formed on the blade surface of each blade 2. For example, the thickness of the velocity boundary layer formed on the blade surface of each blade 2 is smaller on the outer circumferential side of the blade 2. Thus, the width dimension 10 of the recesses 8 provided in the leading edge portion 5 of the blade 2 can be smaller on the outer circumferential side of the blade 2.

Furthermore, this configuration of the fan 100 can reduce amounts of turbulence occurring in the leading edge portions 5 of the blades 2. Consequently, it is possible to curb increases in the drag occurring on the blade 2 and reduce deterioration in fan performance.

Figure 6:
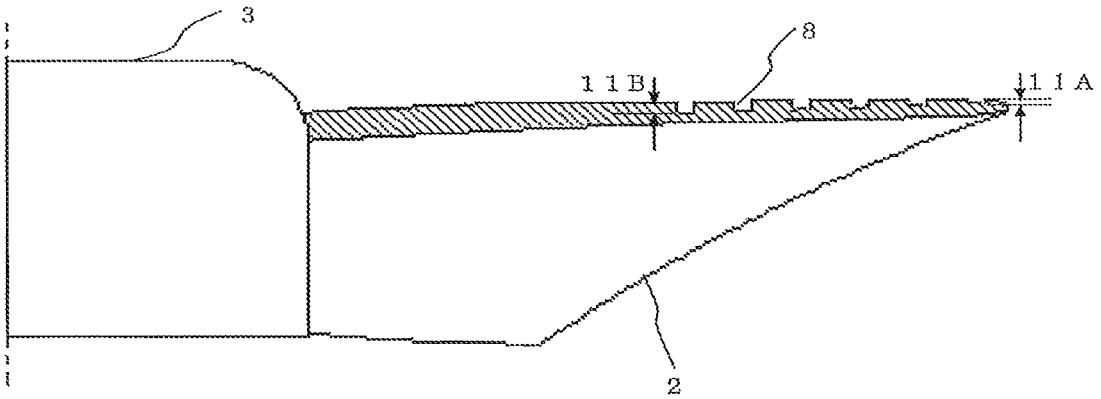
FIG. 6 is a diagram showing another example of the fan 100 according to Embodiment 3 of the present invention.

FIG. 6 is a diagram showing another example of the fan 100 according to Embodiment 3 of the present invention. Depths of plural recesses 8 on the outer circumferential side and the inner circumferential side of the blades 2 of the fan 100 will be described with reference to FIG. 6.

The blade 2 of the fan 100 shown in FIG. 6 is configured such that, of rectangular recesses 8 disposed in the leading edge portions 5 of the blades 2, a depth dimension 11A of the recesses 8 disposed on the outer circumferential side of the blades 2 is smaller than a depth dimension 11B of the recesses 8 disposed on the inner circumferential side. As described above, the thickness of the velocity boundary layer formed on the blade surface of each blade 2 is smaller on the outer circumferential side of the blade 2. As the depth dimension 11A of the recesses 8 disposed on the outer circumferential side of the blades 2 is smaller than the depth dimension 11B of the recesses 8 disposed on the inner circumferential side, the velocity boundary layer can be broken. Consequently, it is possible to reduce the fluctuations of lift occurring on the blade 2 when the blade 2 passes through the wake created by the structure member 9 and reduce generation of discrete frequency noise.

Figure 7:
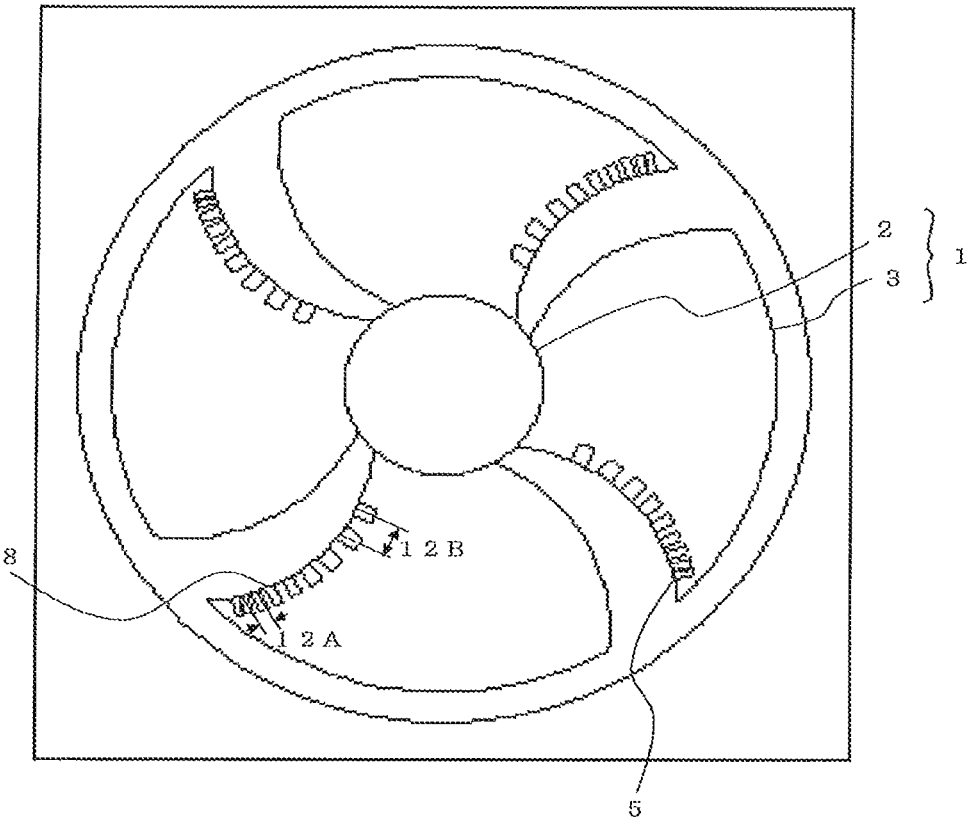
FIG. 7 is a diagram showing still another example of the fan 100 according to Embodiment 3 of the present invention.

FIG. 7 is a diagram showing still another example of the fan 100 according to Embodiment 3 of the present invention. The fan 100 shown in FIG. 7 is configured such that, of rectangular recesses 8 disposed in the leading edge portions 5 of the blades 2, spacing 12A between the recesses 8 disposed on the outer circumferential side of the blades 2 is narrower than spacing 12B between the recesses 8 disposed on the inner circumferential side.

In the impeller 1, the circumferential velocity of the blades 2 is higher on the outer circumferential side of the blades 2. Consequently, discrete frequency noise caused by interference with the wake created by the structure member 9 installed on the upstream side of the fan 100 is more likely to occur on the outer circumferential side of the blades 2. Consequently, fluctuations of lift are larger on the outer circumferential side of the blade 2 than on the inner circumferential side. When the spacing 12A between the recesses 8 disposed on the outer circumferential side of the blades 2 is set to be narrower than the spacing 12B between the recesses 8 disposed on the inner circumferential side, the effect of reducing fluctuations of blade power due to changes in the attack angle caused by the recesses 8 is higher on the outer circumferential side of the blade 2 than on the inner circumferential side. Consequently, it is possible to effectively reduce discrete frequency noise generated on the outer circumferential side where the circumferential velocity is high.

Embodiment 4

Figure 8:
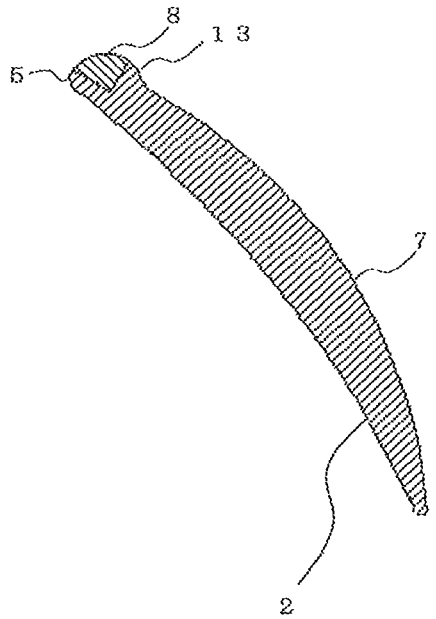
FIGS. 8(*a*) and 8(*b*) are diagrams showing a structure of a blade 2 of a fan 100 according to Embodiment 4 of the present invention.
Figure 8:
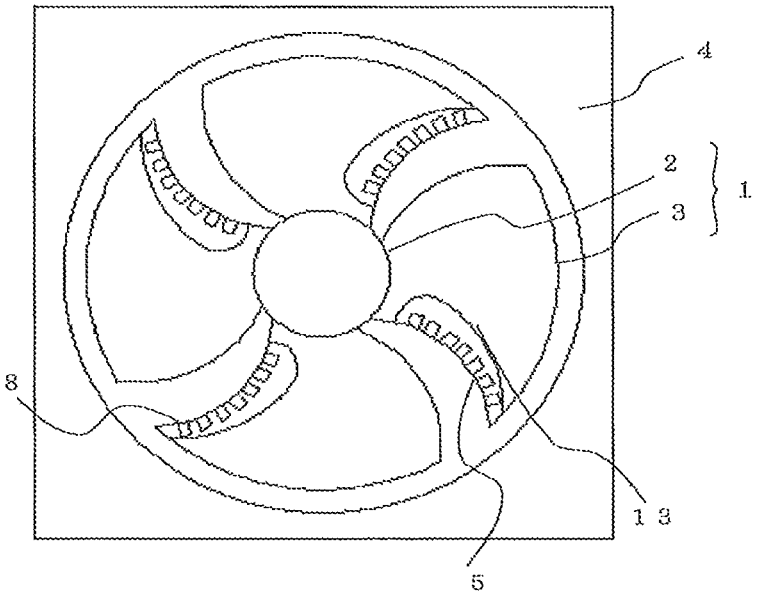

FIGS. 8(*a*) and 8(*b*) are diagrams showing a structure of a blade 2 of a fan 100 according to Embodiment 4 of the present invention. FIG. 8(*a*) shows a section of a blade cascade obtained by developing a cylindrical section at a certain radius into a plane. Also, FIG. 8(*b*) is a diagram of the fan 100 as viewed from a suction-surface side. In Embodiment 4, items and other features not described specifically are similar to corresponding items according to Embodiments 1 to 3. Also, components and other parts having the same functions, configurations, and other features as in Embodiment 1 to 3 are denoted by the same reference signs as the corresponding components of Embodiment 1 to 3.

In the fan 100 according to Embodiment 4, each blade 2 provided with recesses 8 in the leading edge portion 5 has a substantially arc-shaped projection 13, which is a convex portion, on the suction surface 7 of the leading edge portion 5 provided with the recesses 8. Due to the substantially arc-shaped projection 13, when the blade 2 passes through the wake created by the structure member 9 installed on the upstream side of the fan 100, the substantial attack angle of the air current in the leading edge portion 5 varies more greatly between the portions in which the recesses 8 are formed and the portions in which no recess 8 is formed.

Consequently, it is possible to further reduce the fluctuations of lift occurring on the blades 2 when the blades 2 of the rotating impeller 1 pass through the wake of the structure member 9 and effectively reduce generation of discrete frequency noise. Also, the substantially arc-shaped projections 13, which are provided in regions of the leading edge portions 5 in which the recesses 8 are provided, can keep down deterioration in fan performance caused by increased blockages.

Furthermore, a height dimension of the substantially arc-shaped projections 13 may be reduced on the outer circumferential side of the blades 2. For example, by reducing the height dimension of the substantially arc-shaped projections 13 on the outer circumferential side of the blades 2, it is possible to further reduce deterioration in the fan performance caused by increased blockages on the outer circumferential side of the blades 2 while achieving the effect of breaking the velocity boundary layers on the outer circumferential side of the blades 2 where the velocity boundary layers on the blade surfaces are thin.

Embodiment 5

Figure 9:
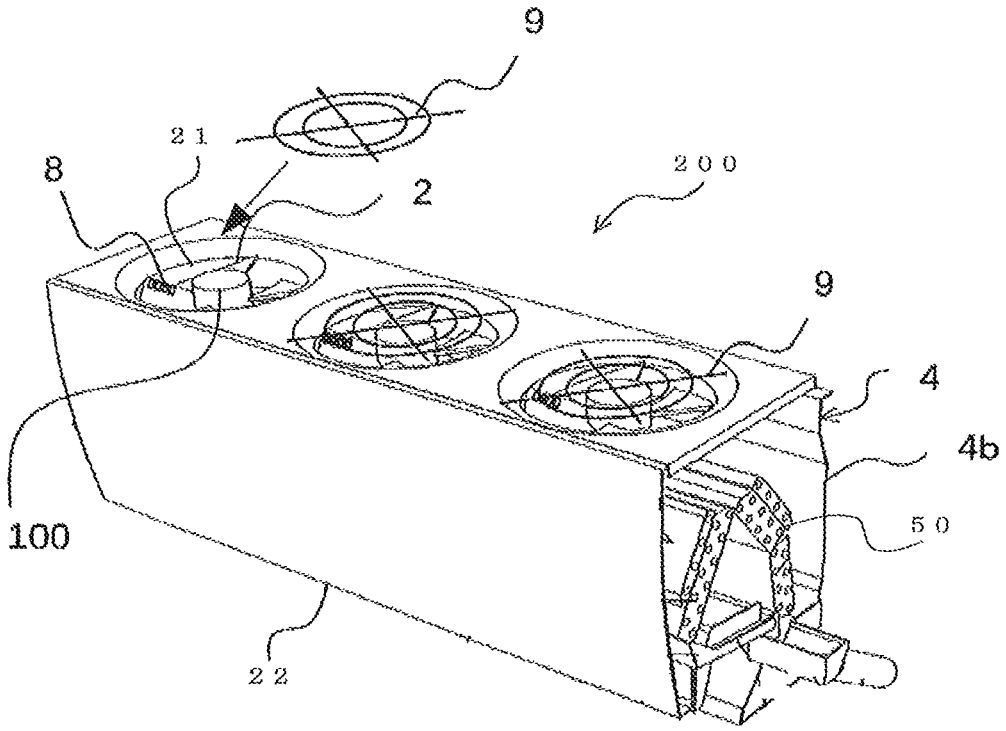
FIG. 9 is a diagram showing an example of an indoor unit 200 according to Embodiment 5 of the present invention.

FIG. 9 is a diagram showing an example of an indoor unit 200 according to Embodiment 5 of the present invention.

Here, to illustrate an internal structure, FIG. 9 shows a part of the indoor unit 200 in an exploded view. The indoor unit 200 according to Embodiment 5 includes the fan 100 described in any one of Embodiments 1 to 4 and is a wall-mounted indoor unit used for an air-conditioning apparatus. However, the fan 100 is applicable not only to wall-mounted indoor units, but also, for example, to floor-mounted outdoor units. Also, the fan 100 is applicable not only to the indoor unit 200, but also to an outdoor unit adapted to condition air using a refrigerant circuit connected with the indoor unit 200 through pipes.

The indoor unit 200 mainly includes a casing 4, the fan 100, and a heat exchanger 50. The casing 4 according to Embodiment 5 houses not only the fan 100, but also the heat exchanger 50. Also, the casing 4 includes an air inlet 21 used to such air, for example, from a room to be air-conditioned into the indoor unit 200 and an air outlet 22 used to supply air-conditioned air into the room. The fan 100 forms a flow of air, causing air to flow through the air inlet 21 into the heat exchanger 50 and flow out through the air outlet 22. The fan 100 is placed on a downstream side of the air inlet 21 but on an upstream side of the heat exchanger 50. In relation to the flow of air, the heat exchanger 50 is placed, for example, on an air course between the fan 100 and air outlet 22. The heat exchanger 50 exchanges heat between refrigerant and air and conditions air. The above components make up an air course passing through the casing 4. The air inlet 21 is formed to open in an upper part of the casing 4. The air outlet 22 is formed to open in a front bottom part of the casing 4. On a rear side 4*b* of the casing 4, the indoor unit 200 is fixed to a wall in the vicinity of a ceiling in the room. Then, the indoor unit 200 sucks air in the vicinity of the ceiling, and blows out conditioned air from a lower side.

Here, the air-conditioning apparatus as a whole forms a refrigerant circuit, for example, by connecting the indoor unit 200 and an outdoor unit (not shown) with each other through pipes. FIG. 9 shows an example of the indoor unit 200 in which three fans 100 are housed in the casing 4, but the number of fans 100 is not particularly limited. For example, one or two fans 100 may be installed.

According to the present embodiment, the finger guard is installed as a structure member 9 over the air inlet 21 on the upstream side of the fan 100. In a part of the fan 100 that is affected greatly by the wake flow of the finger guard, the recesses 8 are disposed in the blades 2. Consequently, it is possible to effectively reduce generation of noise in the indoor unit 200. In particular, when the fan 100 with the recesses 8 provided in the blades 2 is used in the indoor unit 200 in a room for which quietness is required, a quieting effect can be improved.

REFERENCE SIGNS LIST impeller 2 blade 3 boss 4 casing 4*b* rear side 5 leading edge portion 6 trailing edge portion 7 suction surface 8 recess 9 structure member 9A ring-shaped member 9B bar-shaped member 10 width dimension 10A width dimension 10B width dimension 11A dimension 11B dimension 13 arc-shaped projection 21 air inlet 22 air outlet 50 heat exchanger 100 fan 200 indoor unit

The invention claimed is:

1. A fan comprising:

an impeller including a boss serving as a center of rotation and a plurality of blades provided on an outer circumferential surface of the boss; and a structure member installed on an upstream side of the impeller in an airflow direction, the plurality of blades each having a leading edge and a plurality of recesses disposed only on a side of a suction surface of the leading edge of a corresponding blade, the plurality of recesses each having a rectangular shape having two longitudinal sides, and the plurality of recesses are each longitudinal in a direction perpendicular to the leading edge of the corresponding blade in the plurality of blades.

2. The fan of claim 1, wherein the two sides of each of the plurality of recesses each extend along a normal to a line connecting the center of rotation and the leading edge of the corresponding blade in the plurality of blades.

3. The fan of claim 1, wherein the plurality of recesses are each disposed at a position where a wake flow interferes with the leading edge of each of the plurality of blades, the wake flow being a flow of air created behind the structure member.

4. The fan of claim 1, wherein, when the plurality of blades are viewed in a direction of a rotating axis, one of the plurality of recesses is disposed at a position where the one of the plurality of recesses is overlapped by the structure member over at least a quarter of an entire circumference during one rotation of the plurality of blades.

5. The fan of claim 1, wherein one of the plurality of recesses on an outer circumferential side of each of the plurality of blades is narrower in width than one of the plurality of recesses on an inner circumferential side of each of the plurality of blades.

6. The fan of claim 1, wherein one of the plurality of recesses on an outer circumferential side of each of the plurality of blades is shallower than one of the plurality of recesses on an inner circumferential side of each of the plurality of blades.

7. The fan of claim 1, wherein, on each of the plurality of blades, the plurality of recesses are disposed at smaller spacing on an outer circumferential side of the plurality of blades than on an inner circumferential side.

8. The fan of claim 1, wherein the plurality of blades each include a convex portion having an arc shape and provided on the suction surface of the leading edge.

9. The fan of claim 8, wherein the convex portions vary in height in a radial direction of the impeller.

10. An air-conditioning apparatus equipped with the fan of claim 1.

11. The fan of claim 1, wherein the plurality of recesses are provided only on the side of the suction surface of the leading edge of each of the plurality of blades and closer to an outer circumference of each of the plurality of blades than the boss, the plurality of recesses each have the rectangular shape having the two longitudinal sides and are aligned at intervals, a portion of the leading edge of each of the plurality of blades in which one of the plurality of recesses is formed and a portion of the leading edge of each of the plurality of blades in which one of the plurality of recesses is not formed are arranged alternately, spacing between adjacent ones of the plurality of recesses is 0.5 to 3.0 times spacing between the two longitudinal sides of each of the plurality of recesses.

12. The fan of claim 1, wherein the plurality of recesses are each disposed at a position where a wake flow interferes with the leading edge of each of the plurality of blades, the wake flow being a flow of air created behind the structure member, a distance from the structure member to one of the plurality of blades at the position is 1/20 or less of a diameter of each of the plurality of blades.

13. The fan of claim 1, wherein no recess is disposed at a trailing edge of any of the plurality of blades.

14. The fan of claim 1, wherein the plurality of recesses in the leading edge of each of the plurality of blades are the only recesses formed in the leading edge of each of the plurality of blades.

15. The fan of claim 1, wherein a length of one of the plurality of recesses in each blade in a longitudinal direction is 70 to 150% the thickness of the corresponding blade in the plurality of blades.

16. A fan comprising:

an impeller including a boss serving as a center of rotation and a plurality of blades provided on an outer circumferential surface of the boss; and a structure member installed on an upstream side of the impeller in an airflow direction, the plurality of blades each having a leading edge which is curved when viewed in a direction of a rotating axis, and a plurality of recesses disposed only on a side of a suction surface of the leading edge of a corresponding blade, the plurality of recesses each having a rectangular shape having two longitudinal sides, and the plurality of recesses are each longitudinal in a direction perpendicular to the leading edge of the corresponding blade in the plurality of blades, and spacing between a pair of adjacent recesses along the leading edge in a radial direction differs between a side of the leading edge and a side of a trailing edge.

* * * * *